United States Patent [19]

Shimada et al.

[11] 4,395,623

[45] Jul. 26, 1983

[54] SELF-REGULATING ELECTRIC HEATER

[75] Inventors: Minoru Shimada; Kiyofumi Torii, both of Yokaichi, Japan

[73] Assignee: Murata Manufacturing Co., Ltd., Japan

[21] Appl. No.: 239,682

[22] Filed: Mar. 2, 1981

[30] Foreign Application Priority Data

Mar. 4, 1980 [JP] Japan ..... 55/28455[U]
Mar. 4, 1980 [JP] Japan ..... 55/28456[U]

[51] Int. Cl.[3] ..... H05B 3/02

[52] U.S. Cl. ..... 219/544; 219/505; 219/328; 219/540; 219/541; 219/553; 219/311; 338/22 SD; 338/22 R; 338/274

[58] Field of Search ..... 219/504, 505, 523, 530, 219/534, 540, 541, 544, 553, 311, 316, 327, 328; 338/22 R, 22 SD, 316, 274

[56] References Cited

U.S. PATENT DOCUMENTS 3,940,591 2/1976 Ting ..... 219/544
3,955,170 5/1976 Geishedier ..... 338/22 SD
3,976,854 8/1976 Ishikawa et al. ..... 219/553 X
3,996,447 12/1976 Bauffard ..... 219/541
4,091,267 5/1978 Grant ..... 219/544
4,147,927 4/1979 Pirotte ..... 219/541
4,230,935 10/1980 Meixner ..... 219/541 X
4,236,065 11/1980 Yashin et al. ..... 219/544

*Primary Examiner*—Volodymyr Y. Mayewsky
*Attorney, Agent, or Firm*—Ostrolenk, Faber, Gerb & Soffen

[57] ABSTRACT

A self-regulating electric heater includes a casing made of ceramic and a heating unit housed in the casing. The heating unit includes a PTC body for generating heat when electric current is supplied, heat dissipating plates essentially made of brass and coupled to the PTC body in such a manner as to sandwich the PTC body between the heat dissipating plates and terminals connected to each of the heat dissipating plates for the external electrical connection. The self-regulating electric heater further includes lid member and sealing member for sealing the casing hermetically.

7 Claims, 13 Drawing Figures

SELF-REGULATING ELECTRIC HEATER

BACKGROUND OF THE INVENTION

The present invention relates to a heater and more particularly to a heater employing a positive temperature coefficient (PTC) body.

Generally, the above described type of heater is employed in a compressor, used in, e.g., refrigerator or air-conditioning device, for maintaining the lubricant contained in the compressor housing above a predetermined temperature. In conventional refrigeration components, a refrigerant, such as those sold under the trademark "Freon" by E. I. du Pont de Nemours & Co., may, in liquid form, migrate from the condenser into the compressor lubricant. Upon start-up of the compressor, the sudden reduction in crankcase pressure may cause the refrigerant to boil, thus causing the lubricant to form with consequent loss of lubrication to other mechanical parts of the compressor. It has been conventional to employ a crankcase heater to maintain the compressor crankcase at a temperature above that of the rest of the refrigeration system so as to prevent the migration of refrigerant into the crankcase lubricant.

Formerly, fixed constant-resistance heaters were used for heating the crankcase. These heaters, however, were not self-regulating and thus required further temperature controls to limit the heat output of the heater so as to prevent damage to the lubricating oil. These constant-resistance heaters and their associated temperature controls were complicated and expensive.

Then, in order to eliminate such disadvantages, a heater made of ceramic material having a positive temperature coefficient (PTC) of resistivity has been proposed. Such a heater has a relatively low resistance at usual ambient temperatures, but after initial energization by a source of electrical power will self-heat and increase their temperature and resistance. Heat will be generated and the resistance will increase rapidly above a threshold or anomaly temperature until the heat generated balances the heat dissipated at which time the temperature and resistance stabilize with the resistance many times the initial value. Thus, these heaters are self-regulating at a temperature that will not exceed a safe value.

One prior art device employing the PTC element is shown in FIG. 1 includes potting compounds 1 to electrically insulate the PTC heater 2 from the heater case 3 to provide increased heat transfer from the heater to the case and to locate the heater within the case. However, it has been found that certain potting compounds, such as epoxy resin materials or the gases emitted therefrom, deleteriously affect the PTC heater when it is operated at high temperature.

In view of this, an electric heater having a barrier that separates the PTC body and the potting compounds is proposed and is disclosed in detail in U.S. Pat. No. 3,940,591 to Ting, issued on Feb. 24, 1976. However, according to this patent, no consideration is given to the efficiency of heat transmission from the outer surface of the PTC body to the outer surface of the casing.

SUMMARY OF THE INVENTION

Accordingly, it is a primary object of the present invention to provide a self-regulating electric heater which can efficiently transmit heat produced from the PTC body to an outer surface of a casing provided for the PTC body.

It is a further object of the present invention to provide a self-regulating electric heater which is simple in construction and can readily be manufactured at low cost.

In accomplishing these and other objects, a self-regulating electric heater according to the present invention comprises a casing made of electrically non-conductive and thermally high conductive ceramic, and having a cylindrical outer configuration and a chamber formed therein. The chamber has a rectangular cross-section and is opened at one end of the cylindrical casing and is closed at the other end opposing the opened end. A heating unit is housed in the casing in such a manner as to establish a thermal contact with the casing. The heating unit comprises a PTC body for generating heat when an electric current is supplied therethrough. The PTC body has first and second substantially parallel surfaces spaced from one another, said first and second surfaces being deposited with first and second electrodes, respectively, for forming ohmic contact surfaces. The heating unit further comprises first and second heat dissipating plates each essentially made of brass and having first and second flat surfaces, said first and second heat dissipating plates sandwiching the PTC body such that the first flat surface of the first heat dissipating plate is held in contact with the first electrode and the first flat surface of the second heat dissipating plate is held in contact with the second electrode, and first and second terminal means connected to the first and second heat dissipating plates, respectively. The self-regulating electric heater further comprises a biasing means provided in the casing for biasing the heating unit to hold the heating unit in contact with an inner wall of the casing, a lid member mounted on the casing for closing the opening, said lid member having two removed sections for allowing the first and second terminal means to pass therethrough for the external electric connection, and a sealing member deposited around the lid member for sealing the casing hermetically.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DETAILED DESCRIPTION OF THE PREFERRED EMBODIMENTS

Figure 1:
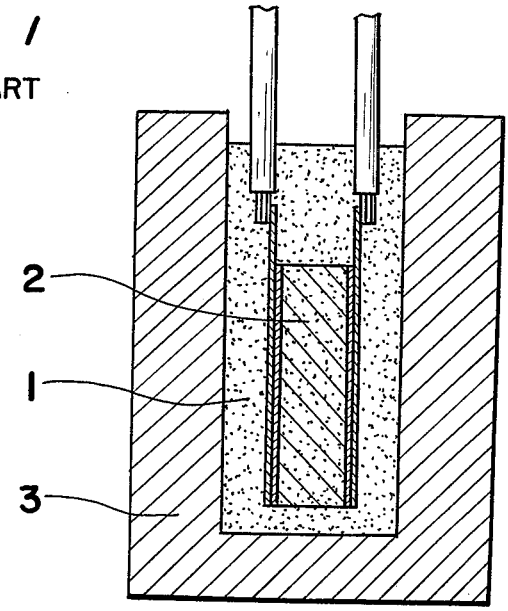
Fig. 1 PRIOR ART
FIG. 1 is a cross-sectional view of a self-regulating electric heater according to the prior art.
Figure 2:
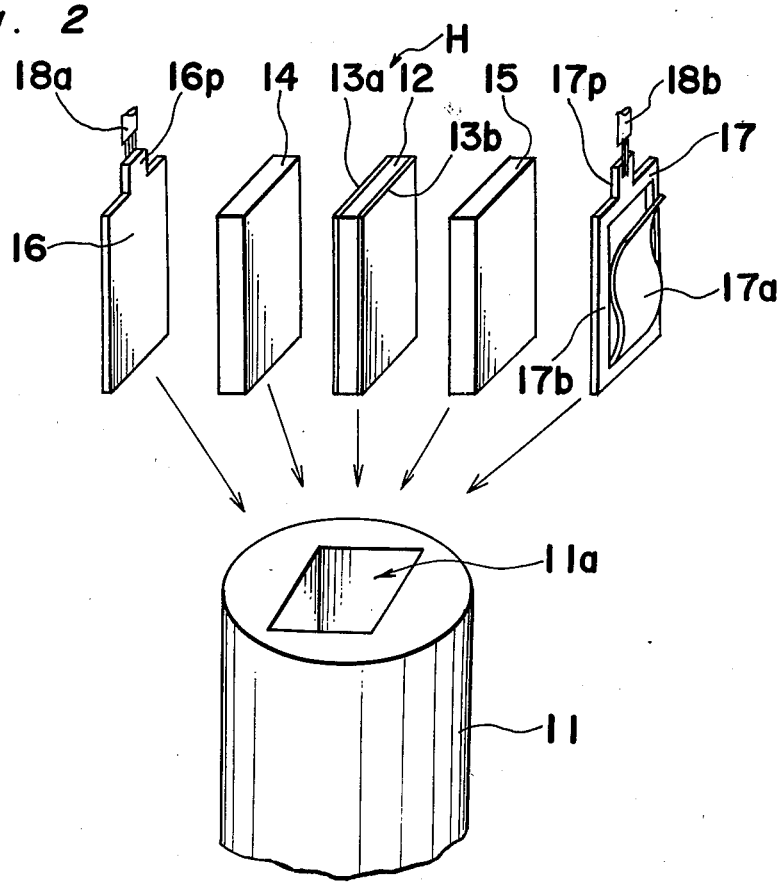
FIG. 2 is an exploded view of a self-regulating electric heater according to a first embodiment of the present invention.
Figure 3:
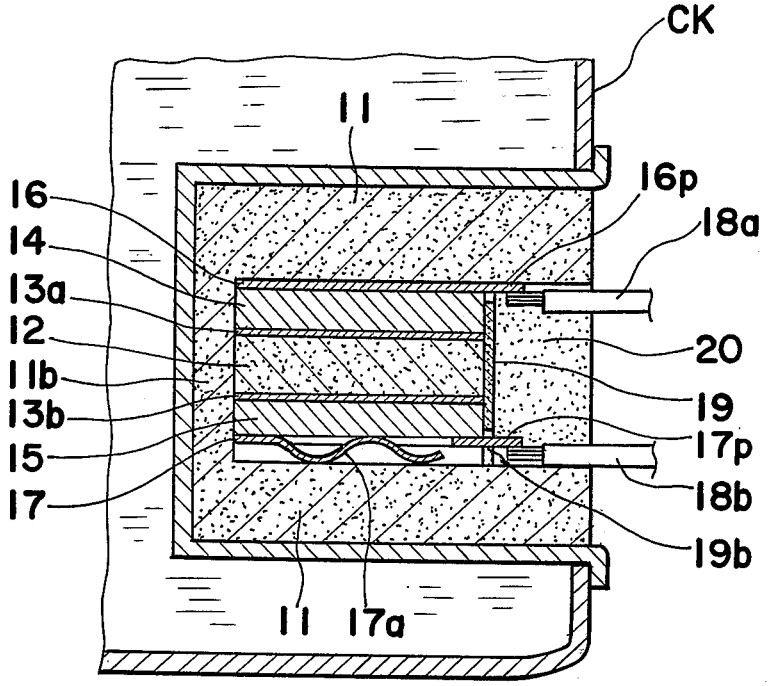
FIG. 3 is a cross-sectional view of a self-regulating electric heater according to the first embodiment of the present invention.

Referring to FIGS. 2 and 3, a self-regulating electric heater according to the first embodiment of the present invention comprises a cylindrical casing 11 made of ceramics having high heat conductivity, such as an alumina ($Al_2O_3$), steatite or mullite, and having a cylindrical outer configuration and a chamber 11*a* formed therein which is opened at one end to form a chamber mouth. The chamber 11*a* has a rectangular cross-section and extends along the axis of the cylindrical casing 11. The other end of the chamber remote from the chamber mouth is closed by a bottom wall 11*b* of the casing 11.

Accommodated in the chamber 11*a* is a heating unit H comprising a PTC element 12, two heat dissipating plates 14 and 15 and two terminal plates 16 and 17. The PTC element 12 has a rectangular configuration with first and second substantially parallel surfaces, respectively, spaced from one another by the thickness of the element. These surfaces are applied with electrode layers 13*a* and 13*b* of electrically conductive material for forming an ohmic contact surfaces. Each of the heat dissipating plates 14 and 15 made of an electrically and thermally conductive material, preferably brass, has approximately the same configuration as that of the PTC element 12 with a predetermined thickness. The heat dissipating plates 14 and 15 are held in contact with the electrodes 13*a* and 13*b*, respectively, in such a manner as to sandwich the PTC element 12 between the heat dissipating plates 14 and 15 for the electrical-contact and heat-transfer. The terminal plate 16 is made of electrically and thermally conductive material, such as brass or stainless steel, and has a configuration similar to the PTC element 12. The terminal plate 16 is positioned next to the heat dissipating plate 14 so that one face of the terminal plate 16 is in electrical-contact and heat-transfer relation with a face of the heat dissipating plate 14 and the other face of the terminal plate 16 is in heat-transfer relation with a first inside surface of the casing 11. The terminal plate 16 has a projection 16*p* extending upwardly, when viewed in FIG. 2, for the electrical connection with a lead wire 18*a* provided with an insulator.

The terminal plate 17 made of electrically and thermally conductive material with high resiliency, such as, brass or stainless steel, has a cut in a shape of U by any known means, such as punching, to form a tongue portion which is corrugated to provide a leaf spring 17*a* in a central portion of the terminal plate 17, and frame portion 17*b* around perimeter of the terminal plate 17. The frame portion 17*b* has an outer configuration similar to that of the PTC element 12. The terminal plate 17 is positioned next to the heat dissipating plate 15 in such a manner that the frame portion 17*b* is in electrical-contact and heat-transfer relation with a face of the heat dissipating plate 15 and the leaf spring 17*a* is heat-transfer relation with a second inside surface, which is opposing the first inside surface, of the casing 11. Accordingly, the biasing force produced by the leaf spring 17*a* is exerted on the heating unit H to tightly hold the PTC element 12 and plates 14, 15, 16 and 17 together and to bias the terminal plate 16 towards and into close heat-transfer relationship with the first inside surface of the casing. The terminal plate 17 has a projection 17*p* extending upwardly, when viewed in FIG. 2, for the electrical connection with a lead wire 18*b* provided with an insulator.

Figure 4:
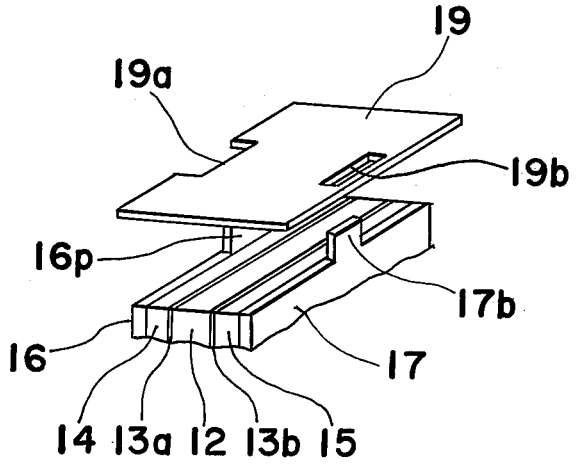
FIG. 4 is a perspective view particularly showing a lid member of the second embodiment of the present invention.

Since the depth of the chamber 11 is greater than the height of the heating unit H, the heating unit H can be completely inserted into the chamber 11, and yet leaving a predetermined space above the heating unit H. After the heating unit H has been inserted into the chamber 11*a* until the bottom of the heating unit H contacts the bottom wall 11*b* of the casing 11, it is hermetically sealed within the chamber 11 by a lid member 19 and sealing material 20 which closes the mouth of the chamber. The lid member 19 has a size approximately equal to the chamber mouth and at least two removed portions for receiving the projections 16*p* and 17*p*, and is placed on top of the heating unit H prior to or subsequent to the connection of lead wires 18*a* and 18*b* with the projections 16*p* and 17*p*, respectively. According to the first embodiment, the removed portions of the lid member 19 are formed by a recess 19*a* and a rectangular opening 19*b*, as best shown in FIG. 4. The connection of the lead wires 18*a* and 18*b* to the projections 16*p* and 17*p* can be carried out by means of spot welding, soldering or clamping, solely, or otherwise in combination of spot welding and clamping. The sealing material 20 made of high heat resistance material, such as silicone resin is injected into the chamber 11*a* above the lid member 19 to positively seal the lead wires 18*a* and 18*b* and hermetically close the mouth of the chamber effectively. By the employment of the lid member 19, the sealing material can be prevented from coming into contact with the PTC element 12, thus avoiding the deterioration of the PTC element.

When in use, the self-regulating electric heater according to the present invention is fittingly inserted into a recess formed in a crankcase CK, as best shown in FIG. 3.

According to the self-regulating electric heater of the present invention, the thickness, width and/or length of each of the heat dissipating plates 14 and 15 can be varied to adjust the coefficient of heat emission from the heat dissipating plates. Accordingly, the heat to be supplied to the crankcase CK can be adjusted.

Since the self-regulating electric heater of the present invention employs heat dissipating plates 14 and 15, the wall of the casing 11 defining the chamber 11*a* is relatively thin when compared with the self-regulating heaters having no heat dissipating plates, provided that the outer configuration of the heater is the same. In other words, it can be said that a part of wall of the casing 11 is replaced by the heat dissipating plates 14 and 15. Since the heat dissipating plates 14 and 15, which are made of brass, has a thermal conductivity of 74 to 79 kcal./m·hr·°C. which is much greater than the thermal conductivity of the ceramic, which has 17 to 22 kcal.m·hr·°C., the heat emitted from the surface of the PTC element can be transferred to the outer surface of the casing 11 with high efficiency. This is further clarified from the following description.

Figure 13:
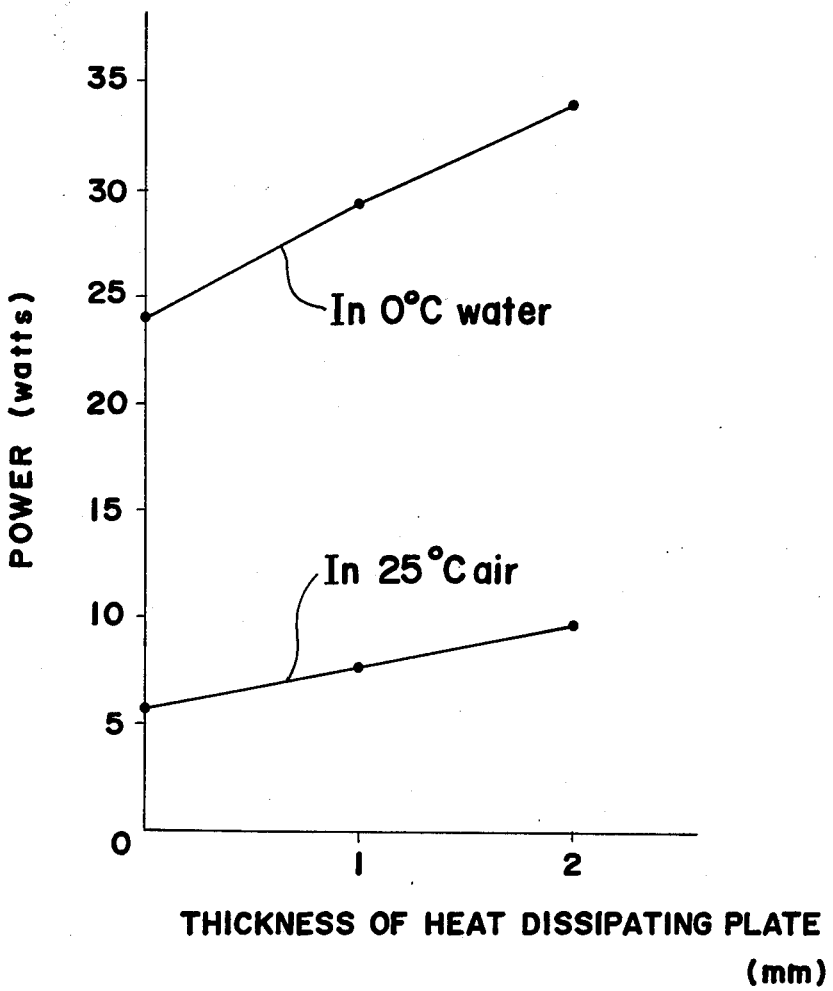
FIG. 13 is a graph showing a relationship between the thickness of a heat dissipating plate and power consumed in the self-regulating electric heater.

Referring to FIG. 13, a graph depicted therein shows a relationship between the thickness (mm) of the heat dissipating block and the power (watt) consumed in the PTC element 12, as obtained through a series of tests carried out by the present inventors. In the tests, a PTC element having a size of 13×20×2.8 (mm) and Curie point of 160° C. is employed, and the voltage supplied to the PTC element is 260 volts (a.c.). When a self-regulating electric heater having no heat dissipating plate is tested, it consumed 24 watts in water (0° C.) and 5.7 watts in air (25° C.). When a self-regulating electric heater having a heat dissipating plate of a size 13×20×1 (mm) is tested, it consumed 29.4 watts in water (0° C.) and 7.7 watts in air (25° C.). And, when a self-regulating heater having a heat dissipating plate of a size 13×20×2 (mm) is tested, it consumed 34 watts in water (0° C.) and 9.7 watts in air (25° C.). As apparent from the tests, the electric power consumed in the PTC element, thus the heat generated from the PTC element, increases as the increase of the thickness of the heat dissipating plates. It is to be noted that the heat generated from the PTC element also increases as the increase of mass of the PTC element.

Figure 5:
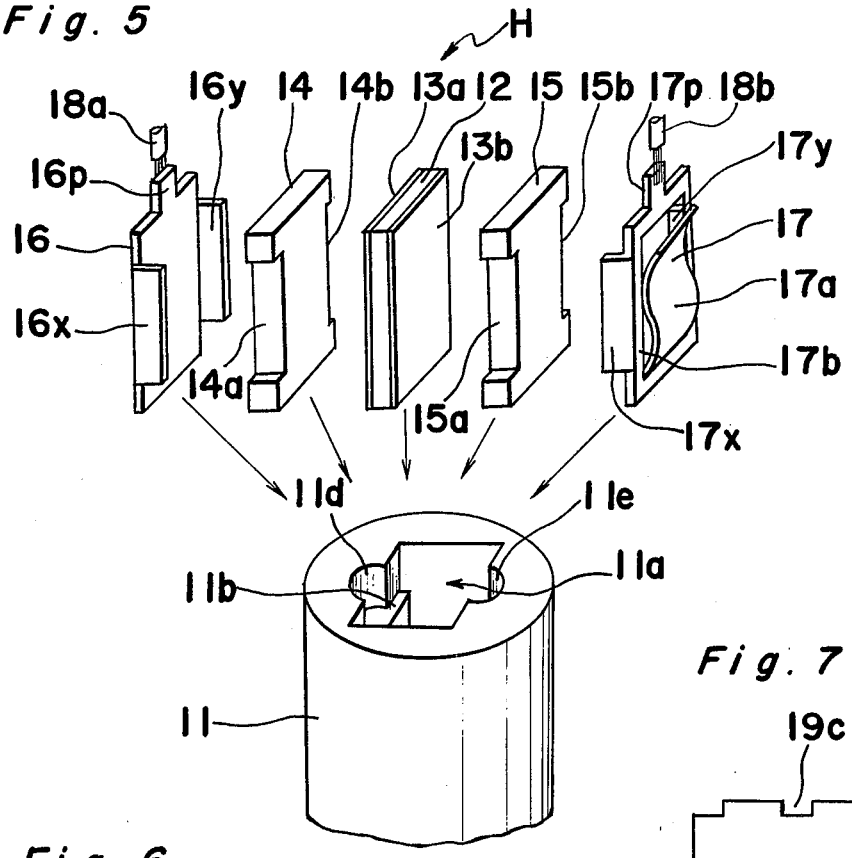
FIG. 5 is an exploded view of a self-regulating electric heater according to a second embodiment of the present invention.
Figure 6:
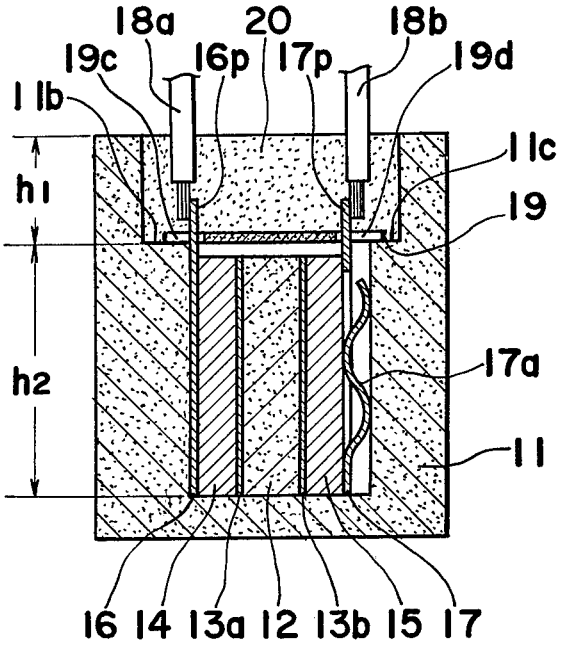
FIG. 6 is a cross-sectional view of a self-regulating electric heater according to the second embodiment of the present invention.

Referring to FIGS. 5 and 6, there is shown a self-regulating electric heater according to the second embodiment of the present invention. In this embodiment, the heat dissipating block 14 has a pair of recesses 14*a* and 14*b* formed in its opposite longitudinal sides which are in parallel relation to the axis of the cylindrical casing. Similarly, the heat dissipating block 15 has a pair of recesses 15*a* and 15*b* formed in opposite longitudinal sides. In compliance with the recesses 14*a* and 14*b*, the terminal plate 16 is provided with a pair of fins 16*x* and 16*y* on opposite long sides and at right angles to the surface of the terminal plate 16 so that when the terminal plate 16 is positioned next to the heat dissipating block 14, the fins 16*x* and 16*y* fittingly engages in recesses 14*a* and 14*b*, respectively. Such an engagement prevents the terminal plate 16 from being slipped aside in the axial direction particularly when inserting the heating unit H into the casing 11. Likewise, the terminal plate 17 is formed with a pair of fins 17*x* and 17*y* which fittingly engage respectively in the recesses 15*a* and 15*b* of the heat dissipating plate 15.

Figure 7:
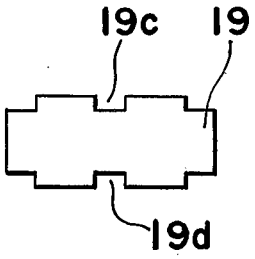
FIG. 7 is a top plan view of a lid member.

According to the second embodiment, the mouth of the chamber 11*a* formed in the casing 11 is somewhat enlarged to form shoulders 11*b* and 11*c* within the chamber 11*a* so as to allow the lid member 19 abut against the shoulders 11*b* and 11*c*, as shown in FIG. 6. Furthermore, the mouth of the casing 11 is formed with semi-cylindrical recesses 11*d* and 11*e* above the shoulders 11*b* and 11*c*, respectively, as best shown in FIG. 6, for facilitating the positioning of lead wires 18*a* and 18*b*. Instead of the recess 19*a* and opening 19*b*, the lid member 19 has a pair of recesses 19*c* and 19*d*, as shown in FIG. 7, for receiving the projections 16*p* and 17*p* of the terminal plates 16 and 17, respectively. Instead of forming the shoulders 11*b* and 11*c*, it is possible to form projections on the inside surface of the casing 11 for supporting the lid member 19.

It is to be noted that the heat dissipating plates 14 and 15 of the second embodiment serves in the same manner as those described above in the first embodiment.

It is also to be noted that the engagement effected between the heat dissipating plate and the terminal plate, e.g., between 15 and 17, can also be accomplished by a pair of fins provided on top and bottom sides, when viewed in FIG. 5, of the terminal plate 17. In this case, the heat dissipating plate 15 is not necessarily be formed with recesses for receiving such fins.

Figure 8:
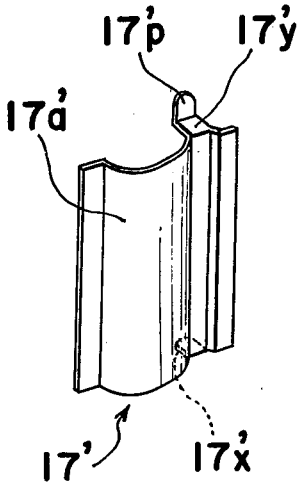
FIG. 8 is a perspective view of a modified terminal member to be employed in the self-regulating electric heater of either one of the first and second embodiments.

It is further to be noted that the terminal plate 17 in either of the first and second embodiments can be replaced by a modified terminal plate 17' shown in FIG. 8. Instead of the leaf spring 17*a*, the modified terminal plate 17' has a semi-cylindrical portion 17'*a* formed between the opposite long sides. Furthermore, the modified terminal plate 17' has a pair of fins 17'*x* and 17'*y* for the engagement with the heat dissipating plate 15. In this case, the projection 17'*p* for the electrical connection with the lead wire 18*b* can be provided on the fin 17'*y* formed at top side of the terminal plate 17'.

Figure 9:
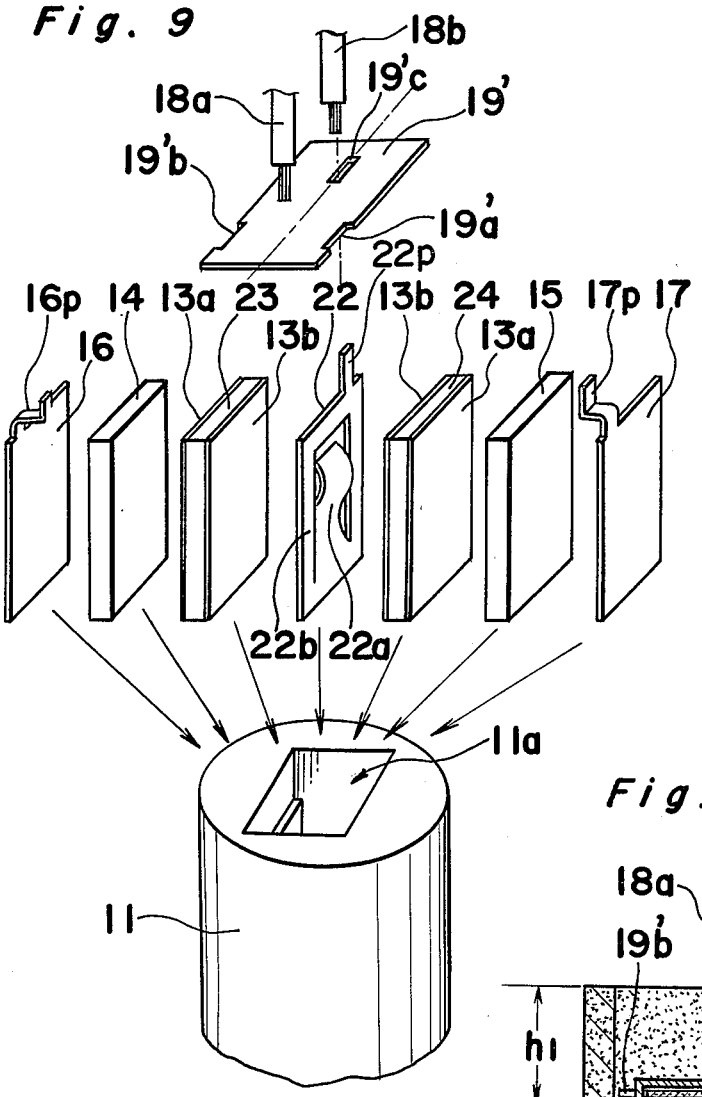
FIG. 9 is an exploded view of a self-regulating electric heater according to a third embodiment of the present invention.
Figure 10:
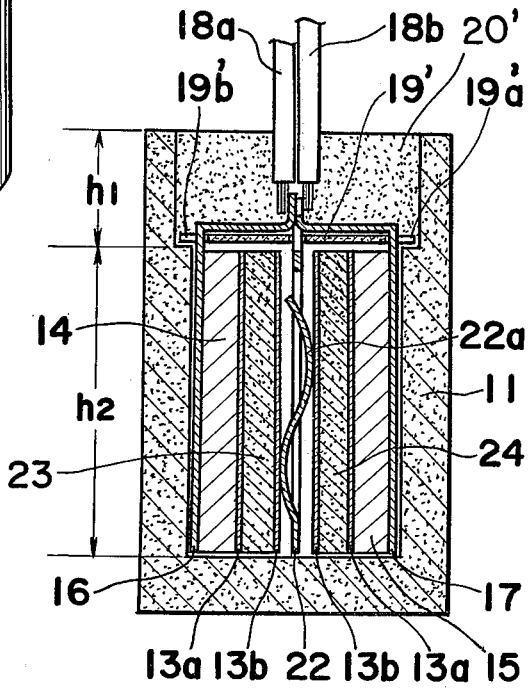
FIG. 10 is a cross-sectional view of a self-regulating electric heater according to the third embodiment of the present invention.

Referring to FIGS. 9 and 10, there is shown a self-regulating electric heater according to the third embodiment of the present invention which includes two PTC elements 23 and 24. For preventing the mutual heat transmission between the PTC elements 23 and 24, the PTC elements 23 and 24 are spaced from each other by a suitable spacer means. More specifically, the heating unit H of this embodiment includes a center terminal plate 22, two PTC elements 23 and 24, two heat dissipating plates 14 and 15, and two side terminal plates 16 and 17, all having approximately the same configuration but different thickness.

The central terminal plate 22, which is sandwiched between the two PTC elements 23 and 24, has a cut in a shape of U by any known means to form a tongue portion which is corrugated to provide a leaf spring 22*a* in a central portion of the terminal plate 22, and frame portion 22*b* around the perimeter of the terminal plate 22. The central plate 22 accordingly serves as terminal means, spring means and spacer means. Each of the PTC elements 23 and 24 has the same configuration as the PTC element 12 described above in the first embodiment and is applied with electrode layer 13*a* and 13*b*. The heat dissipating plate 14 is held in contact with the electrode layer 13*a* of the PTC element 23, and the heat dissipating plate 15 is held in contact with the electrode layer 13*a* of the PTC element 24. The terminal plates 16 and 17, each made of a plain metallic plate, are held in contact with the heat dissipating plates 14 and 15, respectively. When these elements and plates forming the heating unit H are accommodated in the chamber 11*a* of the casing 11, the leaf spring 22*a* pushes the elements and plates away from the central terminal plate 22 so that the terminal plates 16 and 17 are held in contact with opposite inside surfaces of the casing 11 in heat-transfer relation.

The central terminal plate 22 has a projection 22*p* extending upwardly from its top side for the electrical connection with a lead wire 18*a* provided with an insulator, and each of the side terminal plates 16 and 17 has a projection 16*p*, 17*p* extending upwardly from its top side in offset relation with the projection 22*p* for the electrical connection with a lead wire 18*b* provided with an insulator.

Figure 11:
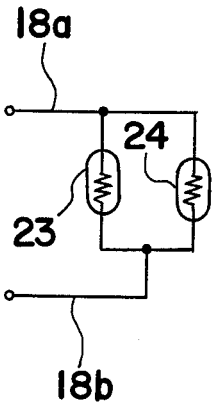
FIG. 11 is a circuit diagram of the self-regulating electric heater of the third embodiment.

Before connecting the lead wires 18*a* and 18*b*, the heating unit H inserted into the chamber 11*a* is hermetically sealed by a lid member 19' which has recesses 19'*a* and 19'b for receiving the projections 16p and 17p, and an opening 19'c for receiving the projection 22p. Preferably, the projections 16p and 17p are bent towards each other to facilitate the connection to the lead wire 18b. After placing the lid member 19' and connecting the lead wires 18a and 18b to the respective projections, the cast-in material serving as a sealing member 20' is injected into the chamber 11a above the lid member 19 to positively seal the lead wires 18a and 18b and hermetically close the mouth of the chamber. According to the third embodiment, the PTC elements 23 and 24 are connected parallelly to each other between the lead wires 18a and 18b, as illustrated in a circuit of FIG. 11.

It is to be noted that the heat dissipating plates 14 and 15 provided in the self-regulating electric heater of the third embodiment contributes in effective heat transmission from each of the PTC elements 23 and 24 to the outer surface of the cylindrical casing 11 in a manner described above in connection with FIG. 13.

Figure 12:
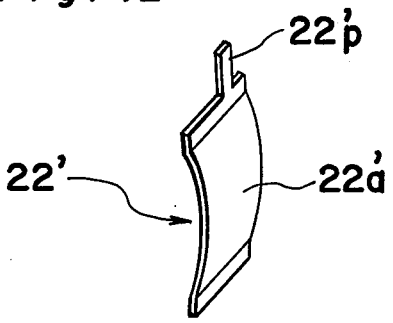
FIG. 12 is a perspective view of a modified terminal member to be employed in the self-regulating electric heater of the third embodiment.

Referring to FIG. 12, there is shown a modified central terminal plate 22' which is constituted by an arcuate portion 22'a producing a spring effect and a projection 22'p for the connection with the lead wire 18a.

It is to be noted that the terminal plates 16 and 17 may have engaging means with respect to the corresponding heat dissipating plates 14 and 15 in a manner described above in connection with FIGS. 5 and 6 or FIG. 8 for preventing the displacement of the terminal plates 17 and 16, particularly when inserting the heating unit H into the chamber 11a.

Although the present invention has been described in connection with several preferred embodiments, many modifications and variations will now be apparent to those skilled in the art, and it is therefore understood that the scope of this invention is limited not by the details of the embodiments described herein, but only by the appended claims.

What is claimed is:

1. A self-regulating electric heater, comprising:

(A) a casing made of electrically non-conductive and thermally high conductive ceramic, said casing having a cylindrical outer configuration and a chamber formed therein, said chamber having a rectangular cross-section and being opened at one end of the cylindrical casing and closed at the other end opposing the open end;

(B) a heating unit housed in said casing in such a manner as to establish a thermal contact with said casing, said heating unit comprising:

(1) a PTC body for generating heat when an electric current is supplied therethrough, said PTC body having first and second substantially parallel planar surfaces spaced from one another, said first and second surfaces having first and second generally planar electrodes, respectively, located thereon for forming ohmic contact surfaces;

(2) first and second heat dissipating plates each made primarily of brass and having first and second flat surfaces, said first and second heat dissipating plates sandwiching said PTC body such that said first flat surfaces of said first heat dissipating plate is flush with said first electrode and said first flat surface of said second heat dissipating plate is flush with said second electrode; and (3) first and second terminal plates sandwiching the combination of said PTC body and said heat dissipating plates such that said first terminal plate is in electrical contact with said second flat surface of said first heat dissipating plate and said second terminal plate is in electrical contact with said second flat surface of said second heat dissipating plate;

(C) a biasing means provided in said casing for biasing said heating unit to hold said heating unit in contact with an inner wall of said casing;

(D) a lid member formed of an electrically insulating material mounted on said casing for closing said open end of said chamber, said lid member having two removed sections for allowing said first and second terminal means to pass therethrough for the external electric connection; and (E) a sealing member formed of an electrically insulated material deposited around said lid member for sealing said casing hermetically.

2. A self-regulating electric heater as claimed in claim 1, wherein said biasing means is a leaf spring rigidly connected to and extending from one of said first and second terminal plate.

3. A self-regulating electric heater as claimed in claim 1, wherein said casing has at least one shoulder formed in said chamber above said heating unit for the support of said lid member.

4. A self-regulating electric heater as claimed in claim 1, wherein said first terminal plate is a metallic plate located between said first heat dissipating plate and one inner wall of said casing, and said second terminal plate is a metallic plate located between said second heat dissipating plate and another inner wall of said casing which is opposing said one inner wall.

5. A self-regulating electric heater as claimed in claim 4, further comprising first engaging means for maintaining said first terminal plate in a predetermined orientation with respect to said first heat dissipating plate, and second engaging means for maintaining said second terminal plate in a predetermined orientation with respect to said second heat dissipating plate.

6. A self-regulating electric heater as claimed in claim 5, wherein said first engaging means comprises at least one fin member extending outwardly from said first terminal plate towards said first heat dissipating plate, and wherein said second engaging means comprises at least one fin member extending outwardly from said second terminal plate towards said second heat dissipating plate.

7. A self-regulating electric heater as claimed in claim 6, wherein said first heat dissipating plate is formed with a recess for receiving said fin member of said first terminal plate, and wherein said second heat dissipating plate is formed with a recess for receiving said fin member of said second terminal plate.

* * * * *